US007845028B2

(12) United States Patent
Lindroos

(10) Patent No.: US 7,845,028 B2
(45) Date of Patent: Dec. 7, 2010

(54) VACUUM SEWER SYSTEM

(75) Inventor: Gunnar Lindroos, Helsinki (FI)

(73) Assignee: Evac International Oy (FI)

( * ) Notice: Subject to any disclaimer, the term of this patent is extended or adjusted under 35 U.S.C. 154(b) by 579 days.

(21) Appl. No.: 11/791,865

(22) PCT Filed: Jan. 23, 2006

(86) PCT No.: PCT/FI2006/050037

§ 371 (c)(1),
(2), (4) Date: Mar. 7, 2008

(87) PCT Pub. No.: WO2006/079688

PCT Pub. Date: Aug. 3, 2006

(65) Prior Publication Data

US 2008/0256697 A1 Oct. 23, 2008

(30) Foreign Application Priority Data

Jan. 25, 2005 (FI) ..... 20055033

(51) Int. Cl.
*E03D 11/00* (2006.01)

(52) U.S. Cl. ..... 4/431; 4/323; 4/434; 137/205; 137/907

(58) Field of Classification Search ..... 4/431, 4/435, 323; 137/205, 236.1, 907
See application file for complete search history.

(56) References Cited

U.S. PATENT DOCUMENTS 4,304,390 A * 12/1981 Kawabata et al. ..... 137/907
4,310,141 A * 1/1982 Tamura ..... 251/28
4,373,838 A * 2/1983 Foreman et al. ..... 137/236.1
5,114,280 A * 5/1992 Ushitora et al. ..... 137/236.1
5,326,069 A 7/1994 Clear et al.
5,588,458 A * 12/1996 Ushitora et al. ..... 137/907
5,634,494 A 6/1997 Martens
5,871,027 A * 2/1999 Shimizu et al. ..... 4/323
6,360,768 B1 * 3/2002 Galler ..... 4/323

FOREIGN PATENT DOCUMENTS

EP 0 659 947 A2 6/1995
EP 0 659 947 A3 6/1995
EP 0825303 A1 2/1998
EP 0825303 B1 2/1998
GB 2 247 327 A 2/1992

* cited by examiner

*Primary Examiner*—Khoa D Huynh
(74) *Attorney, Agent, or Firm*—Dean W. Russell; Kilpatrick Stockton LLP

(57) ABSTRACT

Vacuum sewer system comprising a source of sewage (101), sewer piping (102), a discharge valve (103) between the source of sewage and the sewer piping, means (104) for generating partial vacuum in the sewer piping, and a control means for controlling the operation of the discharge valve. The control means comprises a control mechanism (105) with a body part defining a series of chambers including a first end chamber and a second end chamber, wherein the first end chambers is provided with an activating means (106). The body part (12) is provided with a first port (8) for communication with a source of vacuum (102), a second port (9) for communication with the discharge valve (103) and a third port (10) for communication with an aeration means. The activating means (106) is in connection with a first valve means operating in cooperation with a second valve means, which is displaceable between a first position, providing communication between the second port (9) and the third port (10), and a second position, closing the communication between the second port (9) and the third port (10).

10 Claims, 3 Drawing Sheets

VACUUM SEWER SYSTEM

Cross Reference to Related Applications

Figure 1:
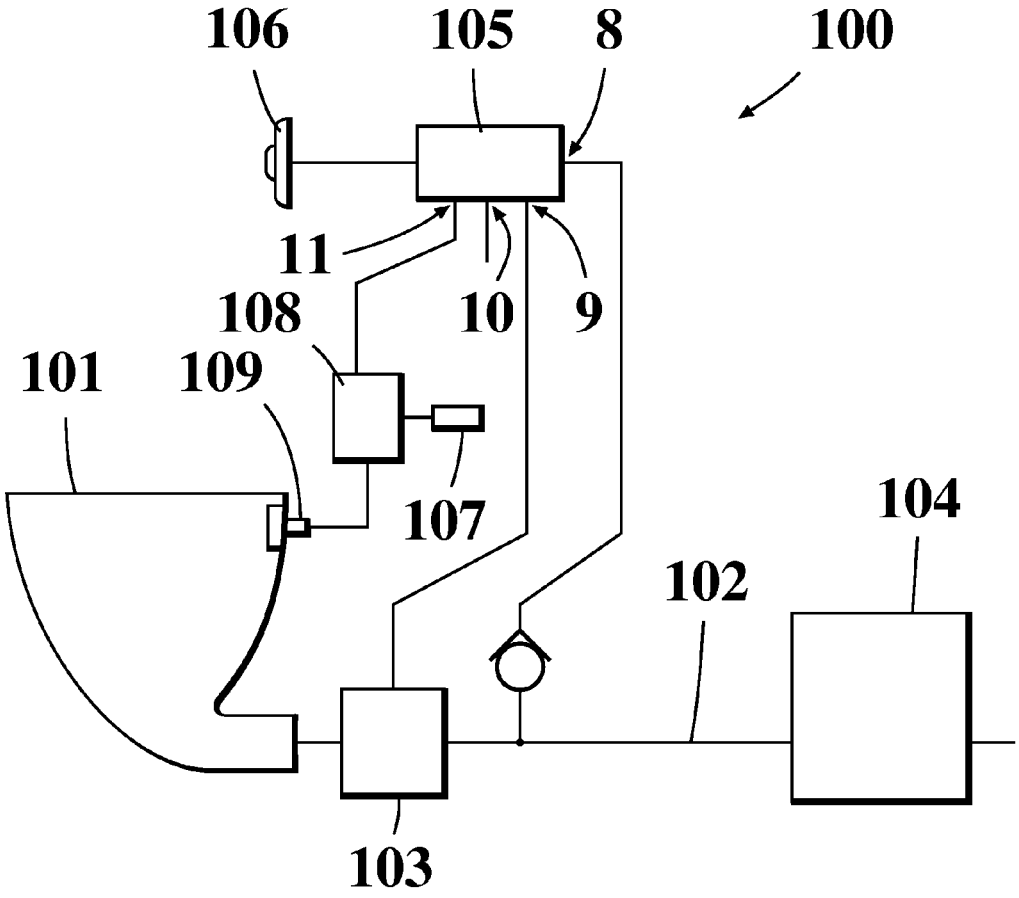

This application is the U.S. national phase of International Application No. PCT/FI2006/050037 filed on Jan. 23, 2006 published in English on Aug. 3, 2006 as International Publication No. WO 2006/079688 A1, which application claims priority to Finnish Application No. 20055033 filed on Jan. 25, 2005, the contents of which are incorporated by reference herein.

The present invention relates to a vacuum sewer system comprising a source of sewage, sewer piping, a discharge valve between the source of sewage and the sewer piping, means for generating partial vacuum in the sewer piping, and a control means for controlling the operation of the discharge valve.

More particularly the invention relates to a control means for a vacuum sewer system, the control means comprising a control mechanism with a body part defining a series of chambers including a first end chamber and a second end chamber, wherein the first end chamber is provided with an activating means, and the body part is provided with a first port for communication with a source of vacuum, a second port for communication with a discharge valve and a third port for communication with an aeration means.

Depending on the source of sewage the vacuum system may also include a rinse water arrangement comprising a rinse water supply, a rinse water valve and a rinse water distribution means for providing rinse water to the source of sewage. Preferably the above mentioned control means also controls the operation of the rinse water arrangement.

Such vacuum sewer systems and control means are previously known. The basic operation principle of the control means is to activate an alternation of partial vacuum and atmospheric pressure in the chambers in order to effect the opening and closing of the discharge valve and preferably also the rinse water valve.

The known solutions generally have a very complex structure and a very large number of components. Furthermore, the interaction of the components is easily disturbed, partly due to their relatively small dimensions and their fragile structure, which results in malfunction of the control means. In addition the known control means are expensive to manufacture and service.

The object of the present invention is to achieve a vacuum sewer system in which the above disadvantages are avoided and which provides a reliable operation by way of a simplified arrangement. A further object of the present invention is to provide a control means, which improves the operation of the vacuum sewer system. These objects are attained by a vacuum sewer system according to claim 1 and a control means according to claim 4.

The basic idea of the invention is to provide a vacuum sewer system, which in the control of the discharge valve, and preferably also the rinse water valve, employs a control means, which in its operation utilises partial vacuum from the system, as known per se, and comprises a mechanically simple structure that secures operation even if some parts are damaged and also provides for provisional maintenance measures. The control means of the vacuum sewer system comprises a series of chambers, in which two valve means operate in sequence in order to open or close communication of partial vacuum to the said valves, the operation being initiated by an activating means.

A preferred embodiment of the vacuum sewer system including a rinse water arrangement is defined in claims 2 to 3.

Preferred embodiments of the control means employed in the vacuums sewer system are defined in claims 5 to 11.

Figure 2:
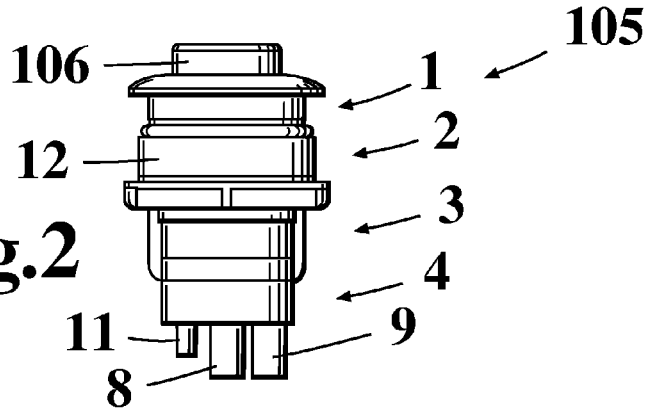
Figure 3:
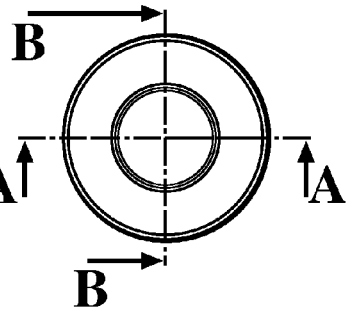
Figure 4:
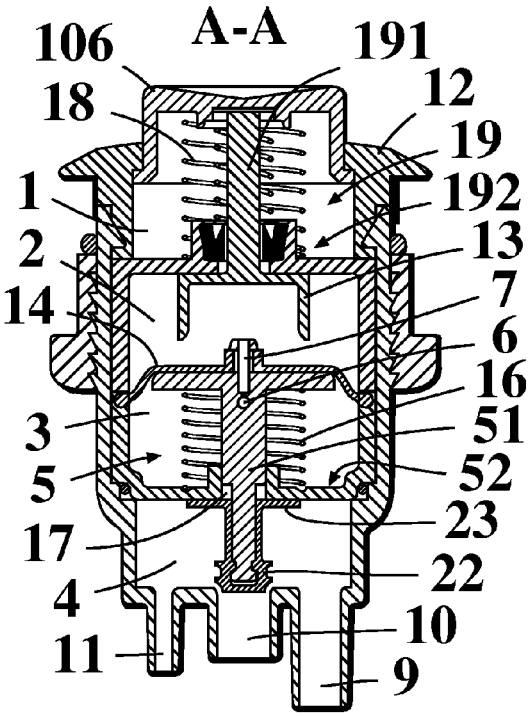
Figure 5:
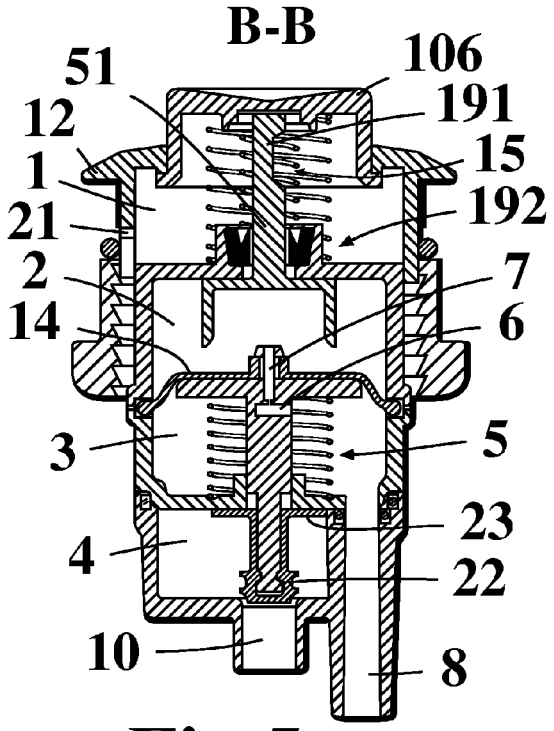

In the following the invention will be described, by way of example only, more in detail with reference to the accompanying schematic drawings, in which FIG. 1 shows a vacuum sewer system employing a control means, FIG. 2 shows a general view of the control means, FIG. 3 indicates a sectioning of the control means as shown in FIGS. 4 and 5, FIG. 4 shows section A-A according to FIG. 3, FIG. 5 shows section B-B according to FIG. 3, and FIGS. 6 to 9 show an operational sequence of the control means.

The vacuum sewer system 100 shown in FIG. 1 comprises a source of sewage 101, in this case a sewage receptacle in the form of a sanitary unit, such as a toilet bowl provided with an outlet, sewer piping 102, a discharge valve 103 between the source of sewage and the sewer piping, and means 104 for generating partial vacuum in the sewer piping. The operation of the discharge valve 103 is controlled by a control means comprising a control mechanism 105 provided with an activating means 106. The vacuum sewer system further includes rinse water arrangement comprising a rinse water supply 107, a rinse water valve 108 and a rinse water distribution means 109 for providing rinse water to the toilet bowl. The control means is also arranged to control the operation of the rinse water arrangement, i.e. normally the function of the rinse water valve.

FIG. 2 shows the control mechanism 105 more in detail. The control mechanism 105 has a body part 12 including a series of chambers 1,2,3 and 4. Further the body part 12 is provided with a first port 8 for communication with a vacuum source, i.e. the sewer piping 102 as shown in FIG. 1, a second port 9 for communication with the discharge valve 103 and a third port 10 (FIG. 4) for communication with an aeration means, i.e. generally the atmosphere. In FIG. 1 a fourth port 11 for communication with the rinse water valve 108 is also shown, which constitutes a preferable embodiment.

FIG. 4 shows a first section A-A and FIG. 5 shows a second section B-B according to FIG. 3 of the control mechanism shown in FIG. 2. The body part 12 of the control means defines a series of chambers arranged on top of each other. These include a first chamber 1, which constitutes a first end chamber, a second chamber 2, a third chamber 3 and a fourth chamber 4, which constitutes a second end chamber.

The first chamber 1 is provided with the activating means 106, e.g. usually a so-called flush button, arranged to engage a first spring 18 biased first valve means 19 including a first valve stem 191 connected to an engagement means 13, in this embodiment shown as a suction cup. The first valve stem 191 is provided with a recess 15, the function of which will be described below in connection with FIGS. 6 to 9. The first chamber 1 is provided with an aeration opening 21 in the side wall of the body part 12. The first chamber 1 and the second chamber 2 are separated by a first valve seat 192, which seats the first valve means 19.

The engagement means 13 is arranged in the second chamber 2 for engagement with a membrane 14 disposed between and separating the second chamber 2 and the third chamber 3. The engagement means is preferable a suction cup in this embodiment. However, other engagement means providing appropriate engagement with the membrane could also be used, whereby the membrane would be designed accordingly.

The term membrane is to be understood as a means providing an appropriate flexible function for movement within the body part 12. The membrane 14 is connected to a second spring 16 biased second valve means 5. The second valve stem 51 of the second valve means 5 is provided with a first duct 6 and a second duct 7, the function of which will be described below in connection with FIGS. 6 to 9. The first port 8 is in communication with the third chamber 3. The second port 9, the third port 10 and the fourth port 11 are arranged in the fourth chamber 4. The third chamber 3 and the fourth chamber 4 are separated by a second valve seat 52, which seats the second valve means 5. The second valve means 5 comprises a second valve stem 52 which is provided with a valve flap 23 and a sealing means 22.

In the following the operational sequence of the control mechanism 105 will be described with reference to FIGS. 6 to 9. The expression "forward" indicates a first direction from the first chamber 1 towards the fourth chamber 4 and the expression "backward" a direction opposite to the first direction.

Figure 6:
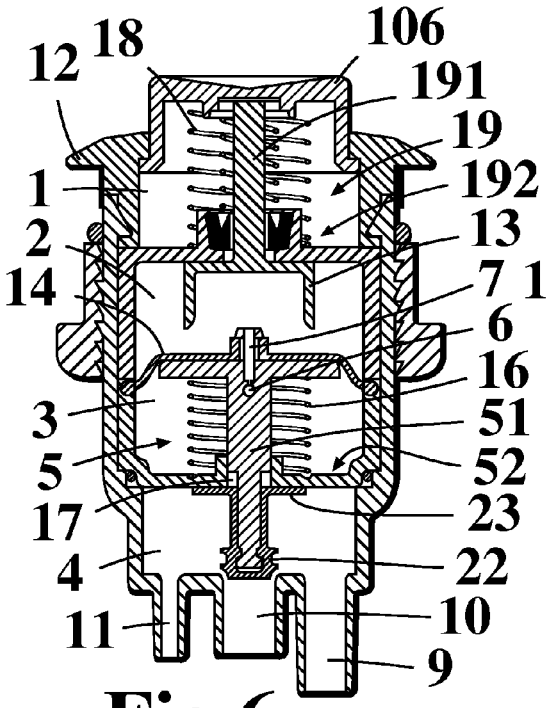
Figure 7:
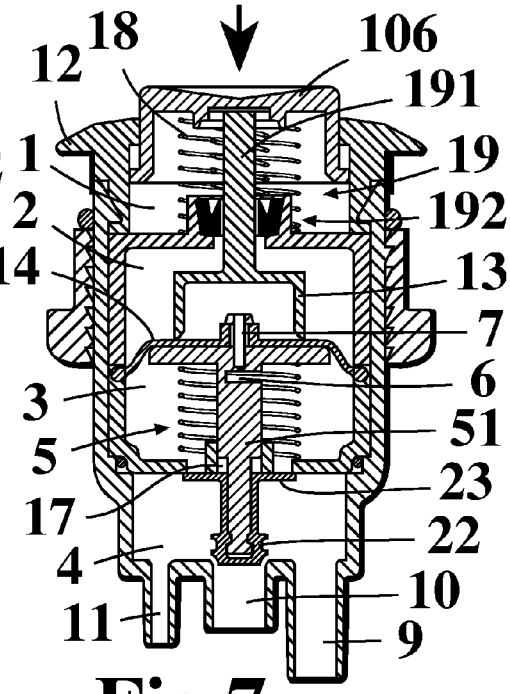

The control mechanism 105 is shown in a normal rest position in FIG. 6. A partial vacuum is connected to the third chamber 3 through the first port 8 (FIG. 5), which is in communication with the vacuum source, i.e. the sewer piping 102, and further communicated to the second chamber 2 through the first duct 6 and the second duct 7, which forms a flow restrictor, arranged in the second valve stem 51. Atmospheric pressure prevails in the first chamber 1, which is aerated through the aeration opening 21 in the side wall of the body part 12 (FIG. 5), and the fourth chamber 4, the third port 10 being open. The second valve stem 51 of the second valve means 5 is provided with a valve flap 23 which closes the communication through a channel 17 formed in the valve seat 52 between the fourth chamber 4 and the third chamber 3. The second valve means 5 with the valve flap 23 is retained in this closing position by the second spring 16 and the pressure difference between the third chamber 3 and the fourth chamber 4.

The discharge valve 103 is in communication with the second port 9 and the rinse water valve 108 is in communication the fourth port 11, whereby they remain aerated as the third port 10 is open and in connection with the atmosphere.

The control mechanism 105 is activated (FIG. 7) by pressing (indicated by an arrow) the activating means 106, in this case in the form of a press button, whereby the first valve means 19 with the engagement means 13 is pushed forward against the membrane 14. This movement moves the recess 15 in the first valve stem 191 towards the first valve seat 192 providing communication between the first chamber 1 and the second chamber 2 through a channel thus formed by the recess 15 and the first valve seat 192 thus letting atmospheric pressure flow from the first chamber 1 into the second chamber 2. Due to the resulting pressure difference the engagement means 13 engages the membrane 14. Further, the pressure difference between the second chamber 2 and the third chamber 3 (in communication with the first port 8 providing vacuum) pushes the second valve means 5 and the first valve means 19 forward.

Figure 8:
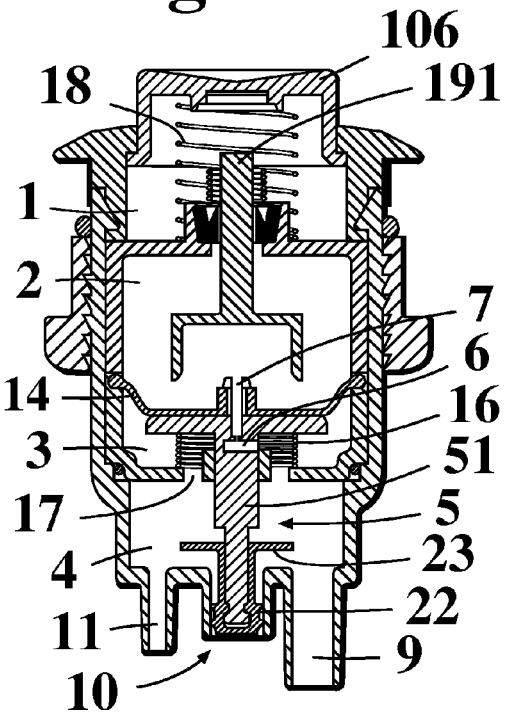
Figure 9:
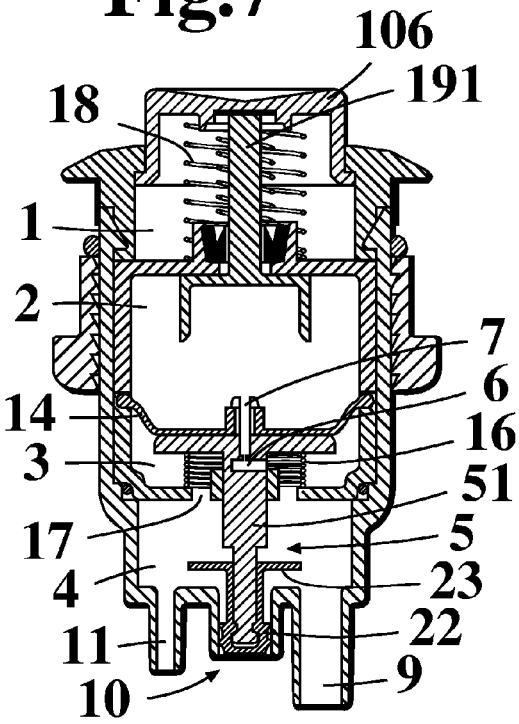

The so-called opening phase is shown in FIG. 8. As the second valve means 5 moves forward the second valve stem 51, which is provided with a sealing means 22 at its forward end, closes the third port 10. When the force exerted by the membrane 14 exceeds the holding force of the valve flap 23 and the second spring 16, the first valve means 5 opens, whereby the connection between the third chamber 3 and the fourth chamber 4 is opened through channel 17. This results in that the partial vacuum from the third chamber 3 is communicated into the fourth chamber 4 and further through the second port 9 towards the discharge valve 103 through the fourth port 11 towards the rinse water valve 108 opening the valves for a flushing sequence. The function of a partial vacuum operated valve is known by the person skilled in the art and is therefor not described in this context.

Just before the second valve means 5 comes to its second, i.e. end position, the first valve means 19 arrives at its most forward position where its further movement is stopped by the first valve seat 192, whereby the engagement means 13 is released from the membrane 14. This results in that the first spring 18 returns the first valve means 19 with the suction cup 13 to its initial position closing the communication between the second chamber 2 and the first chamber 1. As a consequence, the pressure difference between the second chamber 2 and the third chamber 3 begins to equalise through the first duct 6 and the second duct 7, i.e. the flow restrictor, in the second valve stem 51. The second spring 16 returns the second valve means 5 to its first position and the supply of partial vacuum from the third chamber 3 through channel 17 to the discharge valve and the rinse water valve stops. The third port 10 opens and the discharge valve 103 and the rinse water valve 108 are closed. The rinse water valve 108 has an in-built restrictor means, whereby it closes later than the discharge valve 103 in order to provide a base water level in the toilet bowl.

The length of the flushing period may be varied by the dimensioning of the second duct 7, i.e. the flow restrictor. The flow restrictor is preferably formed by a nozzle, whereby a smaller nozzle bore lengthens the return time giving a longer flushing period.

In normal use the flushing sequence, corresponding to the operational sequence of the valve arrangement in the control means, is initiated by lightly pressing the activating means 106. The flushing sequence may be prolonged by pressing the activating means 106 all the way to its bottom position. If the toilet bowl is clogged or jammed the activating means 106 may kept in the bottom position for some time in order more forcibly flush the toilet bowl.

In the event the membrane 14 is damaged, the flushing sequence may still be initiated by pressing the activating means 106 to the bottom position. In this case, however, the timing function as described above does not work.

The drawings and the description related thereto are only intended for clarification of the basic idea of the invention. The invention may vary in further detail within the scope of the ensuing claims.

The invention claimed is:

1. Vacuum sewer system comprising a source of sewage, sewer piping, a discharge valve between the source of sewage and the sewer piping, means for generating partial vacuum in the sewer piping, and a control means for controlling the operation of the discharge valve, the control means comprising a control mechanism with a body part defining a series of chambers including a first end chamber and a second end chamber, wherein the first end chamber is provided with an activating means, and the body part is provided with a first port for communication with a source of vacuum, a second port for communication with the discharge valve, a third port for communication with an aeration means, a first valve means, and a second valve means whereby the activating means is in connection with the first valve means provided with an engagement means, which engagement means is arranged for releasable engagement with the second valve means which is displaceable between a first position, providing communication between the second port and the third port, and a second position, closing the communication between the second port and the third port, wherein the vacuum sewer system further comprises a rinse water arrangement comprising a rinse water valve, wherein the control mechanism is arranged to control the operation of the rinse water valve through a fourth port in the body part of the control unit, and wherein the activating means is arranged to be pressed so that when it is pressed the first valve means with the engagement means is pushed forward so that the second valve means moves forward to its second position for creating a vacuum connection between the first port, the second port and the fourth port.

2. Vacuum sewer system according to claim 1, wherein the rinse water arrangement further comprises a rinse water supply and a rinse water distribution means.

3. Vacuum sewer system according to claim 1, wherein the engagement means comprises a suction cup.

4. Control means for a vacuum sewer system comprising a control mechanism with a body part defining a series of chambers including a first end chamber and a second end chamber, wherein the first end chamber is provided with an activating means, and the body part is provided with a first port for communication with a source of vacuum, a second port for communication with a discharge valve, a third port for communication with an aeration means, a first valve means, and a second valve means, whereby the activating means is in connection with the first valve means provided with an engagement means, which engagement means is arranged for releasable engagement with the second valve means, which is displaceable between a first position, providing fluid communication between the second port and the third port, and a second position, closing the communication between the second port and the third port, wherein the body part of the control mechanism further is provided with a fourth port in communication with a rinse water valve, and wherein the activating means is arranged to be pressed so that when it is pressed the first valve means with the engagement means is pushed forward so that the second valve means moves forward to its second position for creating a vacuum connection between the first port, the second port and the fourth port.

5. Control means according to claim 4, wherein the series of chambers comprises a first chamber, which constitutes the first end chamber, a second chamber, a third chamber and a fourth chamber, which constitutes the second end chamber, wherein the first valve means is arranged for opening and closing communication between the first chamber and the second chamber wherein the second valve means is arranged for opening and closing communication between the third chamber and the fourth chamber, wherein the first port is in communication with the third chamber and wherein the second port, the third port and the fourth port are arranged in the fourth chamber.

6. Control means according to claim 5, wherein the first valve means further comprises a first valve stem and a first valve seat, which separates the first chamber from the second chamber, the engagement means of the first valve means is arranged to engage with a membrane disposed between the second chamber and the third chamber and attached to the second valve means, and wherein the second valve means comprises a second valve stem, a second valve seat, which separates the third chamber and the fourth chamber, and a valve flap.

7. Control means according to claim 6, wherein the first valve stem of the first valve means is provided with a recess which in cooperation with the first valve seat is arranged to provide communication by forming a channel between the first chamber and the second chamber, and in wherein the first chamber is provided with an aeration opening in the side wall of the body part.

8. Control means according to claim 7, wherein the second valve stem is attached to the membrane at one end and is provided with a sealing means at an opposite end, and wherein the sealing means is arranged to engage with the third port at its second position for closing the communication between the second port and the third port.

9. Control means according to claim 8, wherein the second valve stem of the second valve means is provided with a duct arrangement comprising a first duct and a second duct for providing communication between the second chamber and the third chamber.

10. Control means according to claim 5, wherein the engagement means comprises a suction cup.

* * * * *